US008752349B2

(12) United States Patent
Westaby

(10) Patent No.: US 8,752,349 B2
(45) Date of Patent: Jun. 17, 2014

(54) FORM SYSTEM WITH LATH COVERING

(76) Inventor: Jesse Westaby, Alexander, IA (US)

( * ) Notice: Subject to any disclaimer, the term of this patent is extended or adjusted under 35 U.S.C. 154(b) by 21 days.

(21) Appl. No.: 13/526,689

(22) Filed: Jun. 19, 2012

(65) Prior Publication Data

US 2013/0333316 A1 Dec. 19, 2013

(51) Int. Cl.
*E04B 2/00* (2006.01)
*E04B 2/86* (2006.01)

(52) U.S. Cl.
CPC ..... *E04B 2/8647* (2013.01); *E04B 2/8658* (2013.01)
USPC ..... 52/426; 52/309.12; 52/562

(58) Field of Classification Search
CPC ..... E04B 2/8647; E04B 2/8658; E04C 2/044; E04C 2/049; E04C 5/168
USPC ..... 52/426, 427, 428, 309.11, 309.12, 410, 52/562, 565, 309.13, 309.14, 364, 365, 52/366, 367, 368, 369, 370, 371, 372, 373, 52/374, 375, 376; 249/40, 41, 190, 216
See application file for complete search history.

(56) References Cited

U.S. PATENT DOCUMENTS 1,702,672 A * 2/1929 Toogood ..... 249/45
1,800,802 A * 4/1931 Miller ..... 249/215
1,852,049 A * 4/1932 Graef ..... 52/422
1,925,774 A * 9/1933 Phillips ..... 52/346
2,095,714 A * 10/1937 Pinaud et al. ..... 249/214
2,413,415 A * 12/1946 Olson ..... 249/45
2,881,613 A * 4/1959 Taylor et al. ..... 52/479
3,023,660 A * 3/1962 Brown ..... 411/461
3,638,382 A * 2/1972 Merrill ..... 52/359
3,985,329 A * 10/1976 Liedgens ..... 249/40
4,034,950 A * 7/1977 Powell ..... 249/46
4,157,638 A * 6/1979 Della-Donna ..... 52/309.9
4,349,398 A * 9/1982 Kearns et al. ..... 156/71
4,516,372 A * 5/1985 Grutsch ..... 52/309.12
4,773,199 A * 9/1988 Kohara ..... 52/426
4,864,792 A * 9/1989 Andre et al. ..... 52/426
4,875,322 A * 10/1989 Rozzi ..... 52/746.1
4,901,494 A * 2/1990 Miller et al. ..... 52/309.12
4,967,528 A * 11/1990 Doran ..... 52/309.12
4,972,646 A * 11/1990 Miller et al. ..... 52/293.1
5,107,648 A * 4/1992 Roby ..... 52/309.12
5,140,794 A * 8/1992 Miller ..... 52/309.12
5,207,535 A * 5/1993 Saab ..... 405/259.1
5,209,039 A * 5/1993 Boeshart ..... 52/699
5,540,023 A * 7/1996 Jaenson ..... 52/343
5,570,550 A * 11/1996 Roby ..... 52/309.12
5,771,648 A * 6/1998 Miller et al. ..... 52/309.7
5,803,669 A * 9/1998 Bullard ..... 405/257
5,809,725 A * 9/1998 Cretti ..... 52/426

(Continued)

*Primary Examiner* — William Gilbert
*Assistant Examiner* — James Ference
(74) *Attorney, Agent, or Firm* — G. Brian Pingel; David M. Breiner

(57) ABSTRACT

Provided is a concrete form system that may include a first panel, a first connection assembly, a first retaining member, and a lath. The first panel may include a first plurality of apertures. The first connection assembly may include a first bearing structure on a first side of the first panel and a first plurality of cross members penetrating the first plurality of apertures. The first plurality of cross members may include a first plurality of retaining portions exposed on a second side of the first panel. The first retaining member may extend through the first plurality of retaining portions and the lath may be between the first retaining member and the first bearing structure.

15 Claims, 20 Drawing Sheets

(56) References Cited

U.S. PATENT DOCUMENTS

| | | | | |
|---|---|---|---|---|
| 5,887,401 | A * | 3/1999 | Moore, Jr. | 52/426 |
| 6,061,986 | A * | 5/2000 | Canada | 52/561 |
| 6,226,942 | B1 * | 5/2001 | Bonin | 52/309.12 |
| 6,231,024 | B1 * | 5/2001 | Kugimiya et al. | 249/33 |
| 6,282,853 | B1 * | 9/2001 | Blaney et al. | 52/223.7 |
| 6,318,040 | B1 * | 11/2001 | Moore, Jr. | 52/426 |
| 6,405,505 | B1 * | 6/2002 | Alberti | 52/562 |
| 6,647,686 | B2 * | 11/2003 | Dunn et al. | 52/426 |
| 6,691,486 | B1 * | 2/2004 | Durand | 52/645 |
| 6,701,683 | B2 * | 3/2004 | Messenger et al. | 52/309.11 |
| 6,718,712 | B1 * | 4/2004 | Heath | 52/309.12 |
| 6,718,722 | B2 * | 4/2004 | Worrell et al. | 52/741.13 |
| 6,729,090 | B2 * | 5/2004 | Messenger et al. | 52/309.12 |
| 6,832,456 | B1 * | 12/2004 | Bilowol | 52/426 |
| 6,898,908 | B2 * | 5/2005 | Messenger et al. | 52/268 |
| 6,898,912 | B2 * | 5/2005 | Bravinski | 52/426 |
| 6,935,081 | B2 * | 8/2005 | Dunn et al. | 52/426 |
| 6,948,289 | B2 * | 9/2005 | Bravinski | 52/415 |
| 7,124,547 | B2 * | 10/2006 | Bravinski | 52/426 |
| 7,337,591 | B2 * | 3/2008 | Molina | 53/426 |
| 7,415,804 | B2 * | 8/2008 | Coombs et al. | 52/426 |
| 7,516,589 | B2 * | 4/2009 | Messiqua et al. | 52/646 |
| 7,765,761 | B2 * | 8/2010 | Paradis | 52/474 |
| 7,818,935 | B2 * | 10/2010 | Velickovic | 52/426 |
| 7,836,647 | B2 * | 11/2010 | Dauron | 52/292 |
| 2002/0178676 | A1 * | 12/2002 | Yost et al. | 52/426 |
| 2003/0192272 | A1 * | 10/2003 | Bravinski | 52/309.11 |
| 2004/0177580 | A1 * | 9/2004 | Tremelling | 52/426 |
| 2004/0194422 | A1 * | 10/2004 | Rodenhouse | 52/741.1 |
| 2005/0086900 | A1 * | 4/2005 | Reynolds | 52/745.19 |
| 2005/0108985 | A1 * | 5/2005 | Bravinski | 52/782.1 |
| 2005/0257471 | A1 * | 11/2005 | Stevens | 52/443 |
| 2008/0120932 | A1 * | 5/2008 | Paradis | 52/309.8 |
| 2011/0197529 | A1 * | 8/2011 | Calisse | 52/309.1 |
| 2011/0239566 | A1 * | 10/2011 | Ciuperca et al. | 52/259 |

* cited by examiner

FORM SYSTEM WITH LATH COVERING

BACKGROUND

1. Field

Example embodiments relate to a form system having a lath covering and a method of fabricating a form.

2. Description of the Related Art

FIG. 8 is a view of a conventional form 50. As shown in FIG. 8, the conventional form 50 includes a first panel 10, a second panel 20, and a wire grid 30 between the first panel 10 and the second panel 20. In the conventional art, the wire grid 30 includes a plurality of cross rods 32 which are perpendicular to the first and second panels 10 and 20. The conventional form 50 also includes a plurality of outer rods 34 which extend substantially parallel to each other, are disposed against interior surfaces of the panels 10 and 20, and are welded to the plurality of cross rods 32. The form 50 also includes a plurality of inner rods 36 welded to the cross rods 32.

In the form 50, the cross rods 32 have ends that are bent to form retaining portions 32-1. Retaining rods 40 may be threaded into the retaining portions 32-1 to lock the cross rods 32 in place. The retaining rods 40 are configured to reside in longitudinally extending grooves 42 formed in the first and second panels 10 and 20. The retaining portions 32-1 reside in short grooves 44 that are also formed in the first and second panels 10 and 20.

A lath is a wire mesh that is applied to a framework, such as a wood or metal framework. In the conventional art laths serve as a matrix over which building materials, for example, plaster or stucco, is applied. One of the key elements of lath is the openings or gaps in the mesh. The openings allow the plaster or stucco to ooze behind the lath and form a strong bond thereto. Conventional methods of attaching a lath to a wall include using screws and/or anchors.

SUMMARY

Example embodiments relate to a form system having a lath covering and a method of fabricating a form.

In accordance with example embodiments, a form system may include a first panel, a first connection assembly, a first retaining member, and a lath. In example embodiments the first panel may include a first plurality of apertures. The first connection assembly may include a first bearing structure on a first side of the first panel and a first plurality of cross members penetrating the first plurality of apertures. In example embodiments the first plurality of cross members may include a first plurality of retaining portions exposed on a second side of the first panel. The first retaining member may extend through the first plurality of retaining portions and the lath may be between the first retaining member and the first bearing structure.

BRIEF DESCRIPTION OF THE DRAWINGS

Example embodiments are described in detail below with reference to the attached drawing figures, wherein.

DETAILED DESCRIPTION

Figure 1A:
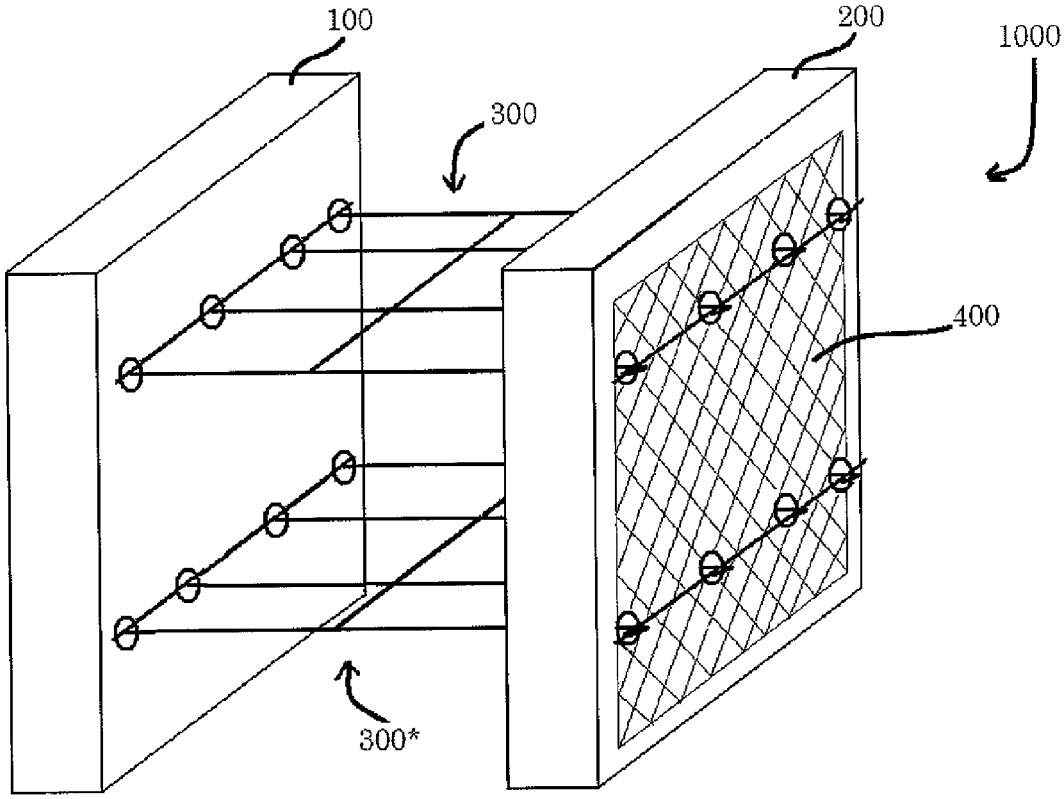
FIGS. 1A-1C are a perspective views of a form system in accordance with example embodiments.

Example embodiments will now be described more fully with reference to the accompanying drawings, in which example embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, the sizes of components may be exaggerated for clarity.

It will be understood that when an element or layer is referred to as being "on," "connected to," or "coupled to" another element or layer, it can be directly on, connected to, or coupled to the other element or layer or intervening elements or layers that may be present. In contrast, when an element is referred to as being "directly on," "directly connected to," or "directly coupled to" another element or layer, there are no intervening elements or layers present. As used herein, the term "and/or" includes any and all combinations of one or more of the associated listed items.

It will be understood that, although the terms first, second, etc. may be used herein to describe various elements, components, regions, layers, and/or sections, these elements, components, regions, layers, and/or sections should not be limited by these terms. These terms are only used to distinguish one element, component, region, layer, and/or section from another element, component, region, layer, and/or section. Thus, a first element component region, layer or section discussed below could be termed a second element, component, region, layer, or section without departing from the teachings of example embodiments.

Spatially relative terms, such as "beneath," "below," "lower," "above," "upper," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the structure in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

Embodiments described herein will refer to plan views and/or cross-sectional views by way of ideal schematic views. Accordingly, the views may be modified depending on manufacturing technologies and/or tolerances. Therefore, example embodiments are not limited to those shown in the views, but include modifications in configurations formed on the basis of manufacturing process. Therefore, regions exemplified in the figures have schematic properties and shapes of regions shown in the figures exemplify specific shapes or regions of elements, and do not limit example embodiments.

The subject matter of example embodiments, as disclosed herein, is described with specificity to meet statutory requirements. However, the description itself is not intended to limit the scope of this patent. Rather, the inventors have contemplated that the claimed subject matter might also be embodied in other ways, to include different features or combinations of features similar to the ones described in this document, in conjunction with other technologies. Generally, example embodiments of the invention relate to a form system having a lath covering.

Figure 1B:
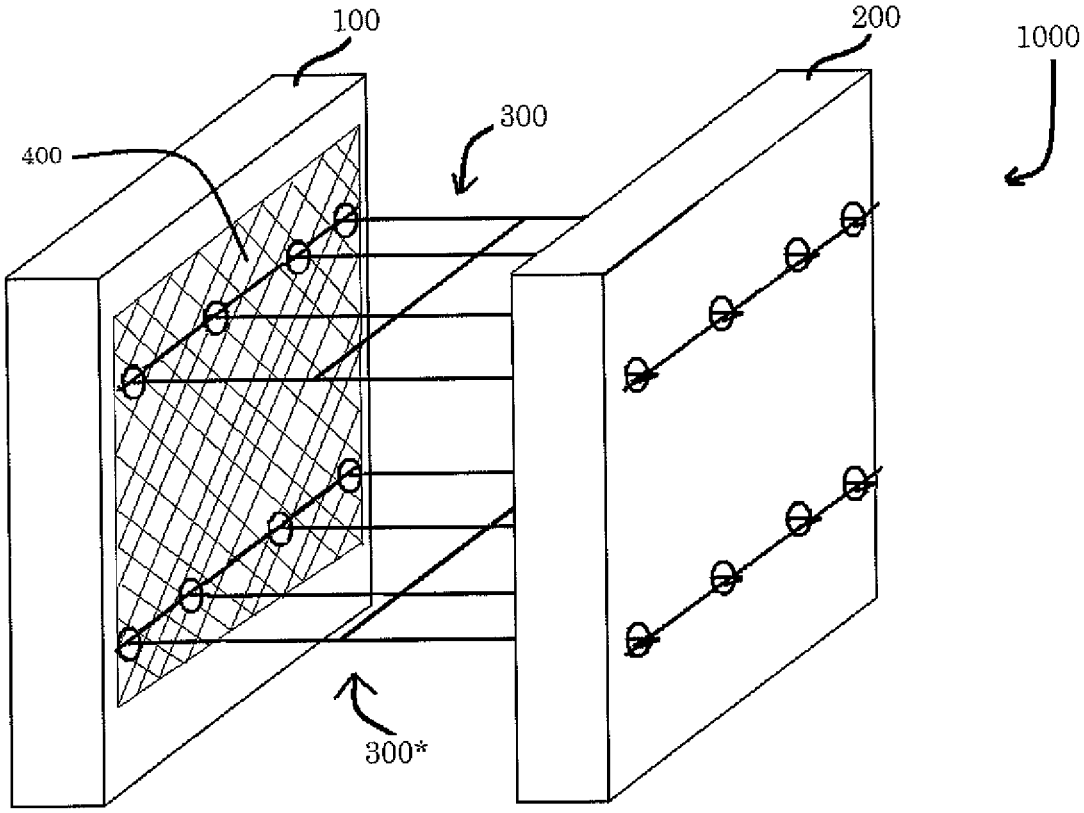
Figure 1C:
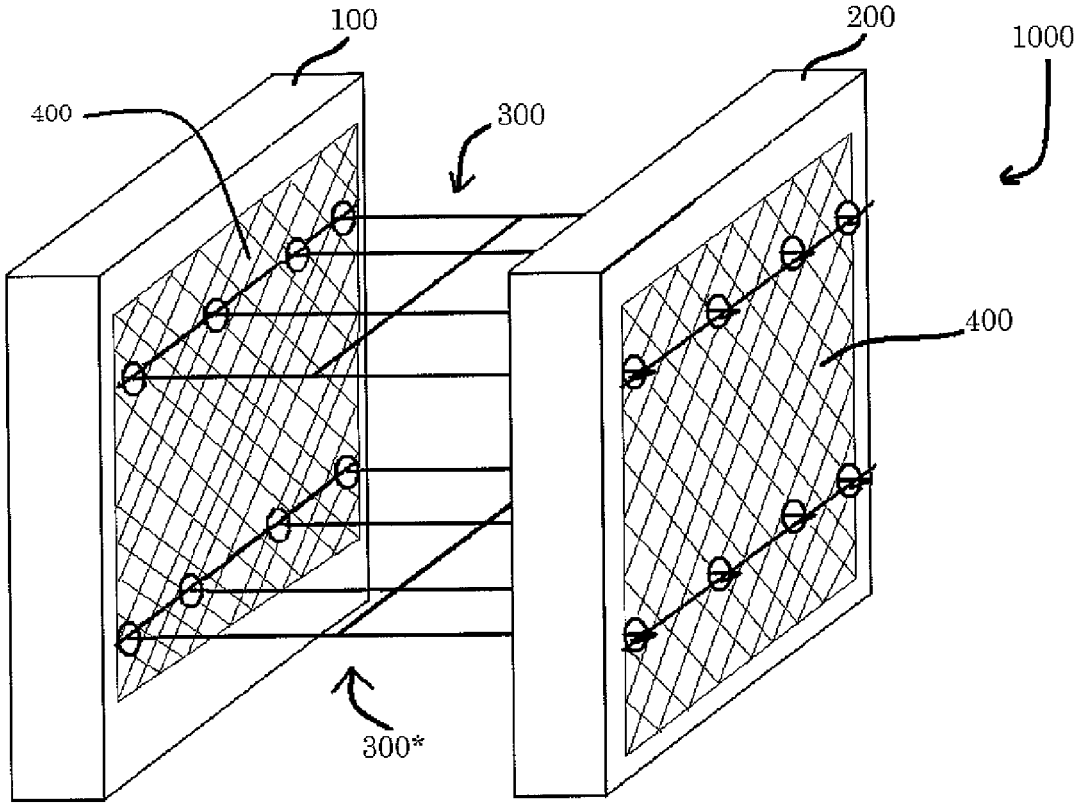

FIGS. 1A-1C are views of a form system 1000 in accordance with example embodiments. In example embodiments, the form system 1000 may include a first panel 100 and a second panel 200 connected to each other by a first connection assembly 300 and a second connection assembly 300*. In example embodiments, the first and second connection assemblies 300 and 300* may, in addition to connecting the first panel 100 to the second panel 200, secure a lath 400 to at least one of the first and second panels 100 and 200. For example, as shown in FIG. 1A, the first and second connection assemblies 300 and 300* may be used to secure a lath 400 to an outside surface of the second panel 200. As another example, the first and second connection assemblies 300 and 300* may be used to secure a lath 400 to an inside surface of the first panel 100 as shown in FIG. 1B. As yet another example, the first and second connection assemblies 300 and 300* may be used to secure a lath 400 to an outside surface of the second panel 200 and an inside surface of the first panel 100 as shown in FIG. 1C. Example embodiments, however, are not limited by the above. For example, inside and outside surfaces of each of the first and second panels 100 and 200 may have a lath secured thereto by the first and second connection assemblies 300 and 300*. As yet another example, the first panel 100 may not have a lath attached thereto whereas the second panel 200 may have a lath secured to both an inside surface and an outside surface thereof. As yet another example, each of the outside surfaces of the first and second panels 100 and 200 may have a lath secured thereto by the first and second connection assemblies 300 and 300*.

Although FIGS. 1A-1C illustrate various examples of the form system 1000 in accordance with example embodiments, the invention is not limited thereto. For example, although the form systems 1000 illustrated in FIGS. 1A-1C include two connection assemblies 300 and 300* to connect the first panel 100 to the second panel 200, the invention is not limited thereto. For example, in example embodiments, the second connection assembly 300* may be omitted. Thus, in example embodiments, only one connection assembly is needed to implement the inventive concepts of the form system 1000. In the alternative, more than two connection assemblies may be used to connect the first panel 100 to the second panel 200. Thus, example embodiments are not limited to a form system 1000 that includes only a single connection assembly or two connection assemblies.

Figure 2A:
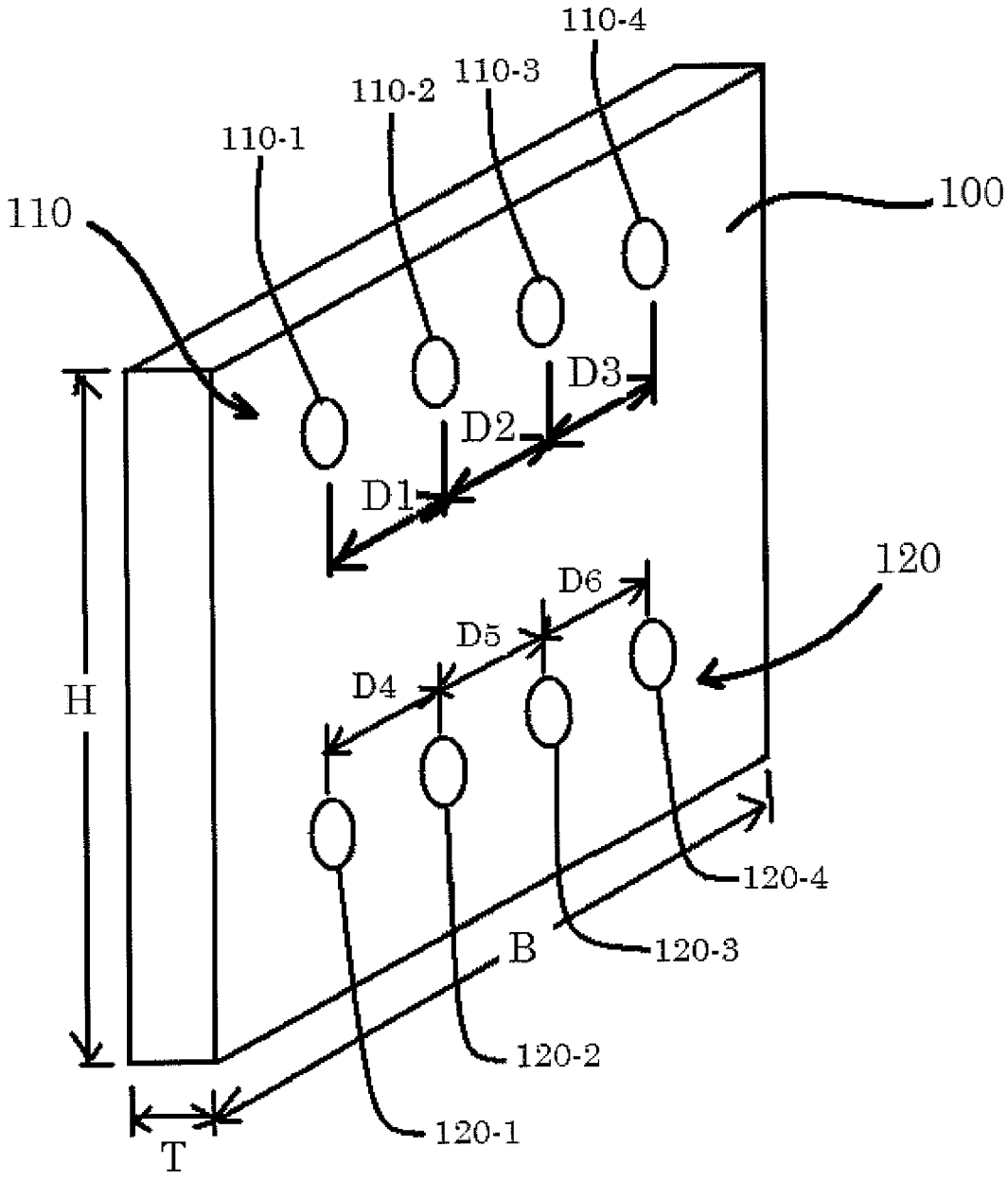
FIGS. 2A-2C are views of a panel in accordance with example embodiments.
Figure 2B:
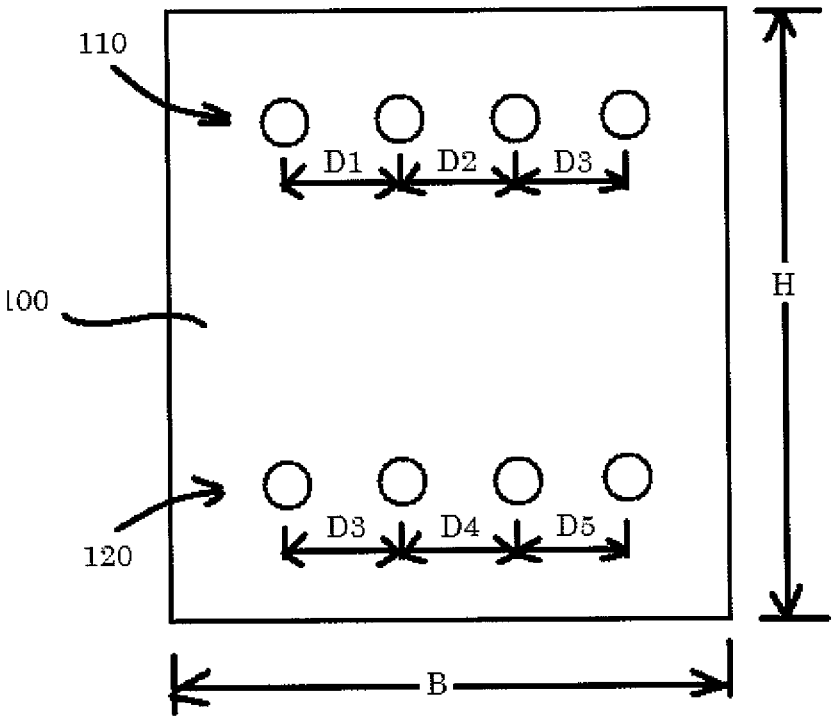
Figure 2C:
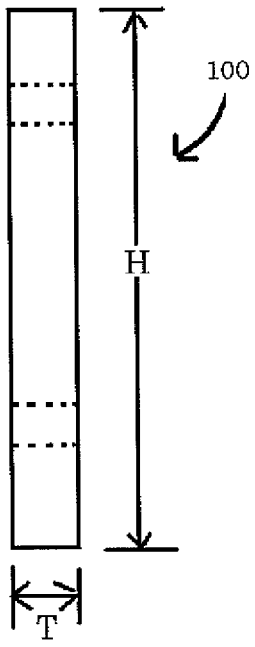

FIGS. 2A-2C illustrate an example of the first panel 100 in accordance with example embodiments. In particular, FIG. 2A is a perspective view of the first panel 100, FIG. 2B is an elevation view of the first panel 100, and FIG. 2C is a side view of the first panel 100. As shown in FIGS. 2A-2C, the first panel 100 may include at least one plurality of apertures. For example, the first panel 100 may include a first plurality of apertures 110 and a second plurality of apertures 120. Although FIGS. 2A-2C illustrate the plurality of apertures as being comprised of a first plurality of apertures 110 and a second plurality of apertures 120, example embodiments are not limited thereto as there may be more than two pluralities of apertures or only a single plurality of apertures.

In example embodiments, the first plurality of apertures 110 may be comprised of a first aperture 110-1, a second aperture 110-2, a third aperture 110-3, and a fourth aperture 110-4, as shown in FIG. 2A. In example embodiments, the first aperture 110-1 may be separated from a second aperture 110-2 by a first distance D1, the second aperture 110-2 may be separated from the third aperture 110-3 by a second distance D2, and the third aperture 110-3 may be separated from the fourth aperture 110-4 by a third distance D3. In example embodiments, each of the first, second, and third distances D1, D2, and D3 may be substantially the same. Thus, the first plurality of apertures 110 may have a substantially uniform or equal spacing. Example embodiments, however, are not limited thereto since the distances D1, D2, and D3 may not be equal. For example, in example embodiments, the first and third distances D1 and D3 may be substantially equal but different from the second distance D2. As yet another example, none of the first, second, and third distances D1, D2, and D3 may be substantially equal. Although FIGS. 2A-2C illustrate the first plurality of apertures 110 as comprising four apertures, example embodiments are not limited thereto as the first plurality of apertures 110 may include more than four apertures or less than four apertures.

In example embodiments, the second plurality of apertures 120 may likewise be comprised of four apertures. For example, the second plurality of apertures 120 may be comprised of a fifth aperture 120-1, a sixth aperture 120-2, a seventh aperture 120-3, and an eighth aperture 120-4, as shown in FIG. 2A. In example embodiments, the fifth aperture 120-1 may be separated from the sixth aperture 120-2 by a fourth distance D4, the sixth aperture 120-2 may be separated from the seventh aperture 120-3 by a fifth distance D5, and the seventh aperture 120-3 may be separated from the eighth aperture 120-4 by a sixth distance D6. In example embodiments, each of the fourth, fifth, and sixth distances D4, D5, and D6 may be substantially the same. Thus, the second plurality of apertures 120 may have a substantially equal spacing. Example embodiments, however, are not limited thereto since the fourth, fifth, and sixth distances D4, D5, and D6 may not be equal. For example, in example embodiments, the fourth and sixth distances D4 and D6 may be equal but different from the fifth distance D5. As yet another example, none of the fourth, fifth, and sixth distances D4, D5, and D6 may be substantially equal. Although FIGS. 2A-2C illustrate the second plurality of apertures 120 as comprising four apertures, example embodiments are not limited thereto as the second plurality of apertures 120 may include more than four apertures or less than four apertures.

In example embodiments, the spacing of the apertures of the first plurality of apertures 110 may be substantially the same as the spacing of the apertures of the second plurality of apertures. For example, as shown in FIGS. 2A and 2B, the spacing of the first, second, third, and fourth apertures 110-1, 110-2, 110-3, and 110-4 may be substantially, the same as the spacing of the fifth, sixth, seventh, and eighth apertures 120-1, 120-2, 120-3, and 120-4. For example, the first distance D1 separating the first aperture 110-1 from the second aperture 110-2 may be the same as the fourth distance D4 separating the fifth aperture 120-1 from the sixth aperture 120-2. Similarly, the second distance D2 separating the second aperture 110-2 from the third aperture 110-3 may be the same as the fifth distance D5 separating the sixth aperture 120-2 from the seventh aperture 120-3. Similar yet, the third distance D3 separating the third aperture 110-3 from the fourth aperture 110-4 may be the same as the sixth distance D6 separating the seventh aperture 120-3 from the eighth aperture 120-4. Example embodiments, however, are not limited thereto. For example, the spacing of the first, second, third, and fourth apertures 110-1, 110-2, 110-3, and 110-4 of the first plurality of apertures 110 may be substantially different from the spacing of the fifth, sixth, seventh, and eighth apertures 120-1, 120-2, 120-3, and 120-4.

In FIGS. 2A-2C the first, second, third, fourth, fifth, sixth, seventh, and eighth apertures 110-1, 110-2, 110-3, 110-4, 120-1, 120-2, 120-3, and 120-4 are illustrated as being circular holes. Although the first, second, third, fourth, fifth, sixth, seventh, and eighth apertures 110-1, 110-2, 110-3, 110-4, 120-1, 120-2, 120-3, and 120-4 may be circular holes, the invention is not limited thereto. For example, the first, second, third, fourth, fifth, sixth, seventh, and eighth apertures 110-1, 110-2, 110-3, 110-4, 120-1, 120-2, 120-3, and 120-4 may be triangular, square, rectangular, hexagonal, or octagonal holes. As another non-limiting example, the first, second, third, fourth, fifth, sixth, seventh, and eighth apertures 110-1, 110-2, 110-3, 110-4, 120-1, 120-2, 120-3, and 120-4 may resemble slits into which retaining portions of the connection assembly 300 may be inserted (to be explained later).

In FIGS. 2A-2C the first panel 100 is illustrated as being a box shaped member having a height H, a base B, and a thickness T. Example embodiments, however, are not limited thereto as the first panel 100 may assume another configuration. For example, rather than having rectangular outer and inner surfaces defined by the height H of the first panel 100 and the base B of the first panel 100, the outer and inner surfaces of the first panel 100 may have a triangular shape, a hexagonal shape, or an octagonal shape. Furthermore, edges of the first panel 100 are not required to be flat as is shown in the figures. For example, the edges of the first panel 100 may be formed with either a slot or a protrusion to allow an adjacent panel to connect thereto when multiple panels are used to form a wall.

In example embodiments, the first panel 100 may be made from a light weight material such as an expanded polystyrene foam (EPF) or its equivalent. Example embodiments, however, are not limited thereto. For example, the first panel 100 may be made from wood, plastic, metal, a composite material, or a combination thereof. In example embodiments, the second panel 200 may have substantially the same features as the first panel 100, therefore, a detailed description thereof is omitted for the sake of brevity.

Figure 3A:
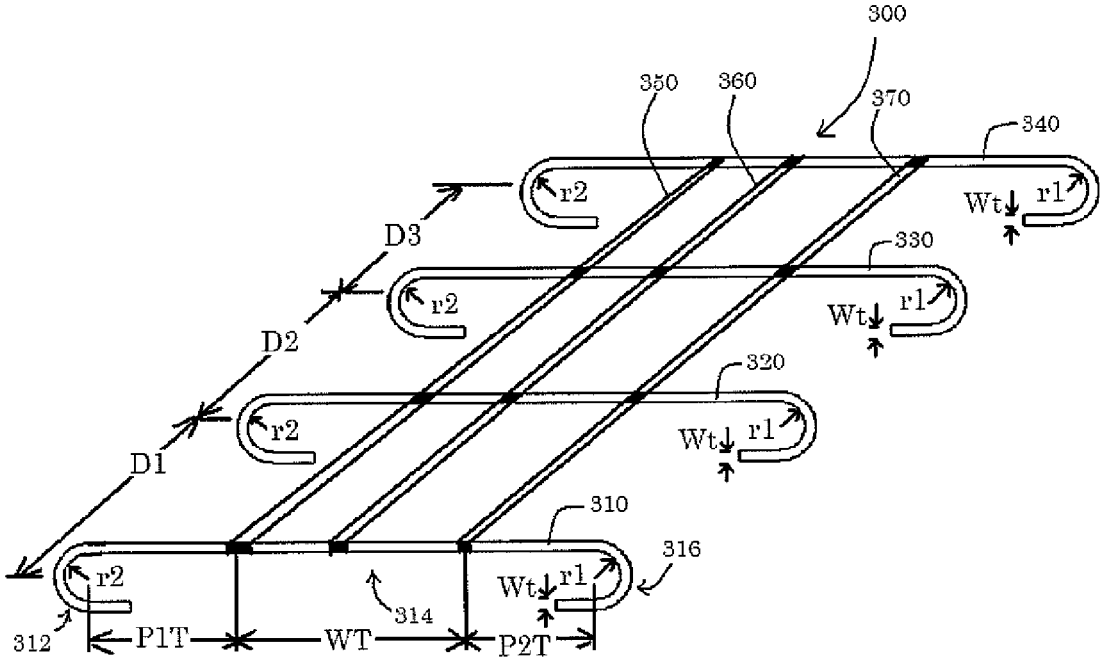
FIG. 3A-3F are views of connection assemblies in accordance with example embodiments.
Figure 3B:
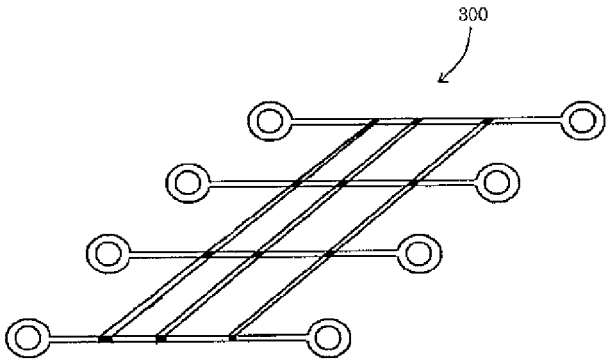
Figure 3C:
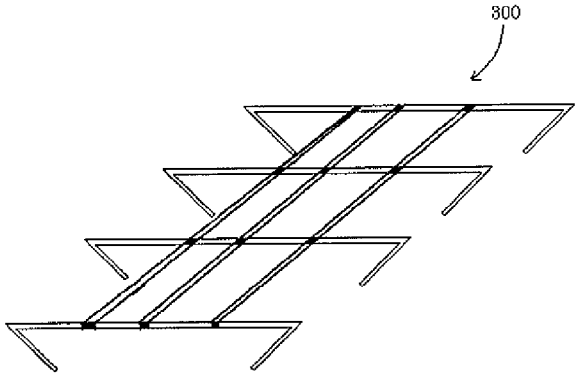
Figure 3D:
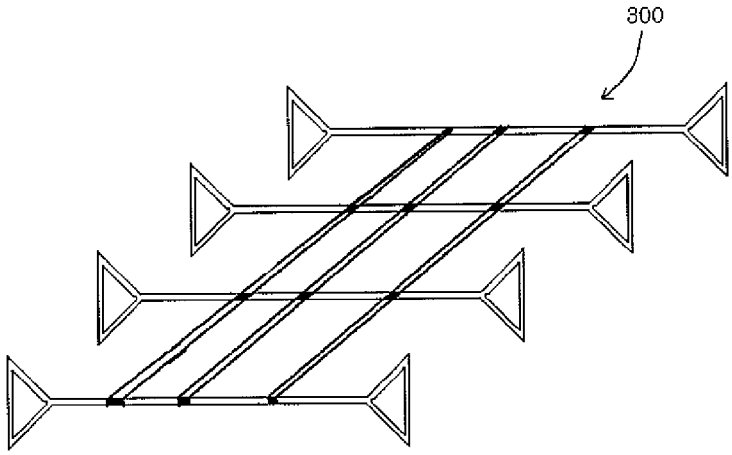
Figure 3E:
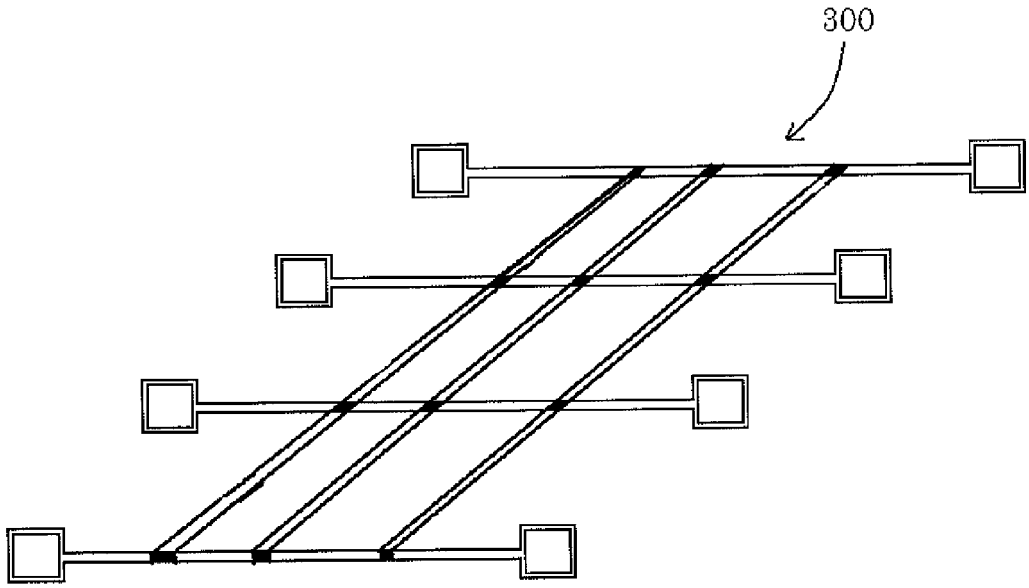
Figure 3F:
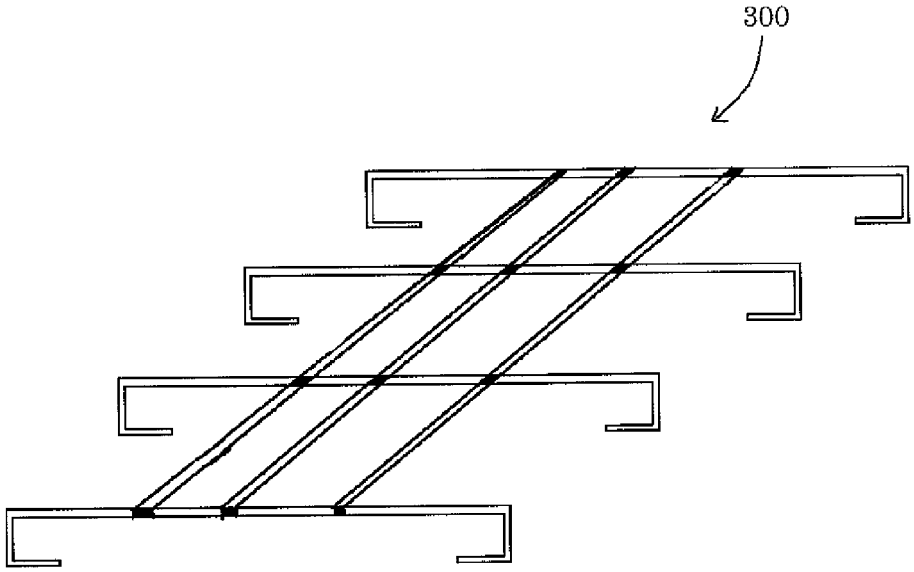

FIG. 3A illustrates an example of the first connection assembly 300. As shown in FIG. 3A, the first connection assembly 300 may be comprised of a plurality of cross rods. For example, as shown in FIG. 3 the first connection assembly 300 may include a first cross rod 310, a second cross rod 320, a third cross rod 330, and a fourth cross rod 340. Although the first connection assembly 300 is illustrated as including four cross rods, the invention is not limited thereto as the first connection assembly 300 may include less than four cross rods or more than four cross rods.

In example embodiments, each of the cross rods 310, 320, 330, and 340 may be made from a wire like material. For example, the cross rods 310, 320, 330, and 340 may be made from a ten gauge wire (meaning that the cross rods would have a diameter Wt of about 0.102 inches). In example embodiments, ends of each of the cross rods 310, 320, 330, and 340 may be formed in a substantially U shape. For example, a first end 312 of the first cross rod 310 may be formed to form a first U-shaped retaining portion whereas a second end 316 of the first cross rod 310 may be formed to form a second U-shaped retaining portion. The second, third, and fourth cross rods 320, 330, and 340 may be similarly configured with retaining portions at the ends thereof.

In example embodiments, the plurality of cross rods may have a spacing which is substantially equal to or identical to a spacing of a plurality of aperatures that may be present in either the first or second panels 100 or 200. For example, if the plurality of cross rods was comprised of the first cross rod 310, the second cross rod 320, the third cross rod 330, and the fourth cross rod 340 as shown in FIG. 3A, and if the first panel 100 included the first plurality of apertures 110 comprised of the first, second, third, and fourth apertures 110-1, 110-2, 110-3, 110-4 having the spacings D1, D2, and D3, then the first cross rod 310 may be separated from the second cross rod 320 by the first distance D1, the second cross rod 320 may be separated from the third cross rod 330 by the second distance D2, and the third cross rod 330 may be separated from the fourth cross rod 340 by the third distance D3. Thus, in example embodiments, the plurality of cross rods of the first connection assembly may be aligned with apertures of at least one of the first and second panels 100 and 200 of the form system 1000.

In example embodiments, the first connection assembly 300 may further include a pair of outer rods 350 and 370 and at least one middle rod 360. The pair of outer rods 350 and 370 may be separated by a distance WT which may be a distance that determines a desired wall thickness (or a separation distance between the first and second panels 100 and 200). For example, in the event the form system 1000 is used to form a concrete wall having a thickness of four (4) inches, the distance WT separating the pair of outer rods 350 and 370 may be about four (4) inches. Like the cross rods 310, 320, 330, and 340, the pair of outer rods 350 and 370 and the at least one middle rod 360 may be made from a wire like material such as a ten gauge wire. In example embodiments, the pair of outer rods 350 and 370 may bear up against (or be close to) inside surfaces of the first and second panels 100 and 200. Therefore, each of the pair of outer rods 350 and 370 may serve as a bearing structure of the first connection assembly 300.

In example embodiments, the at least one middle rod 360 and the pair of outer rods 350 and 370 may be attached to the cross rods 310, 320, 330, and 340. For example, the at least one middle rod 360 and the pair of outer rods 350 and 370 may be welded to the upper surfaces of the cross rods 310, 320, 330, and 340. In the alternative, the at least one middle rod 360 and the pair of outer rods 350 and 370 may be welded to the lower surfaces of the cross rods 310, 320, 330, and 340.

In example embodiments, the first cross rod 310 may include a middle portion 314 between the first end 312 and the second end 316. For example, as shown in FIG. 3A the middle portion 314 of the first cross rod 310 may be defined by the pair of outer rods 350 and 370. Thus, the middle portion 314 of the first cross rod 310 may have the length WT which is substantially the same as the distance which separates a first panel 100 from a second panel 200. The first end 312 may be defined by the first outer rod 350 and may extend to include the first retaining portion. In example embodiments, a length P1T of the first end 312 may be substantially the same as (or slightly larger than) the thickness T of the first panel 100. The second end 316 may be defined by the second outer rod 370 and may extend to include the second retaining portion. In example embodiments, a length P2T of the second end 316 may be substantially the same as (or slightly larger than) a thickness of the second panel 200. In example embodiments, the second, third, and fourth cross rods may be similarly configured.

In example embodiments, the second connecting structure 300* may be substantially the same as the first connecting structure 300, thus, a detailed description of the second connecting structure 300* is omitted for the sake of brevity.

Figure 4:
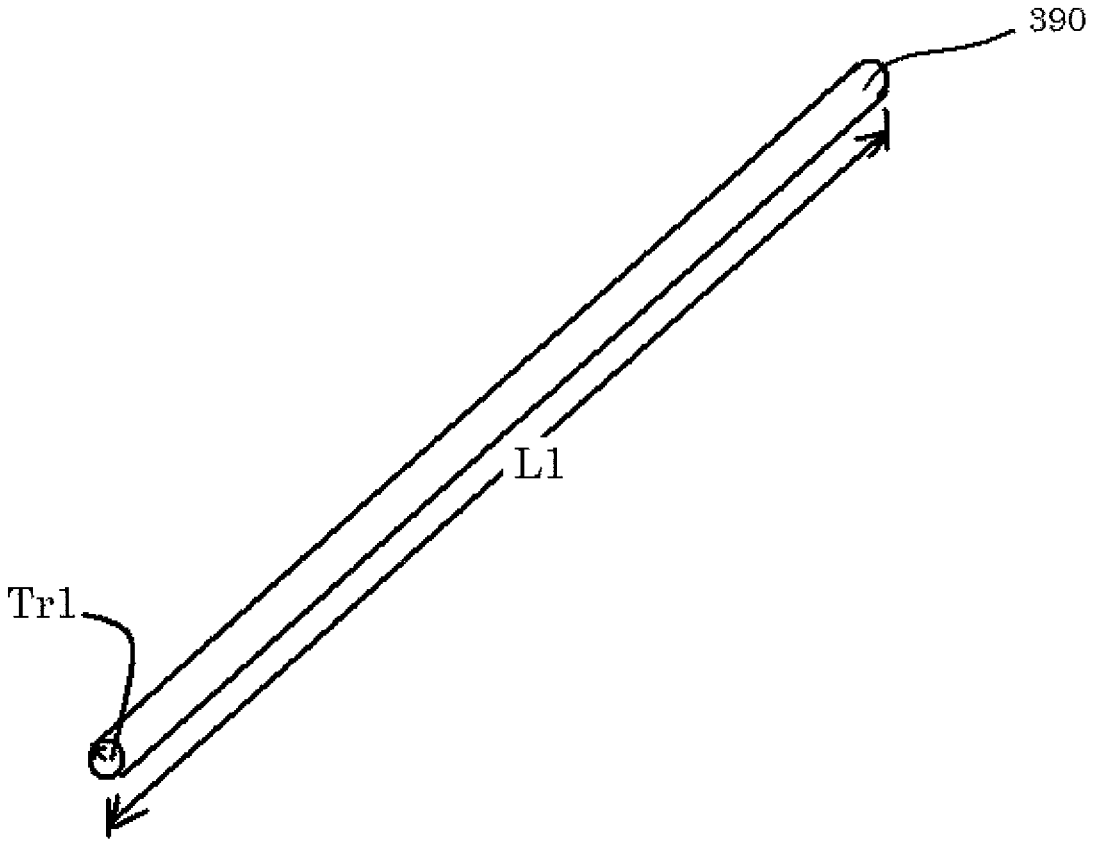
FIG. 4 is a view of a retaining member in accordance with example embodiments.

FIG. 4 is a view of a retaining member 390 in accordance with example embodiments. In example embodiments, the retaining member 390 may be configured to engage the retaining portions of the first connection assembly 300. For example, the retaining member 390 may be a rod like member having a radius Tr1 small enough to allow it to be inserted into the retaining portions of the first and/or second connection assemblies 300 and 300*. For example, in the event the retaining member 390 is configured to engage the first retaining portion of the first cross bar 310, and the first retaining portion of the first cross bar 310 is a substantially U-shaped retaining portion having a radius r2 as shown in FIG. 3A, the then radius Tr1 of the retaining member 390 should be substantially the same as (or slightly smaller than) the radius r2. As another example, in the event the retaining member 390 is configured to engage the second retaining portion of the first cross bar 310, and the second retaining portion of the first cross bar 310 is a substantially U-shaped retaining portion having a radius r1 as shown in FIG. 3A, the then radius Tr1 of the retaining member 390 should be substantially the same as (or slightly smaller than) the radius r2.

In the figures, the retaining portions of the first and second connection assemblies 300 and 300* have been illustrated as being substantially U-shaped. This is not intended to be a limiting feature of the invention. For example, rather than having U-shaped retaining portions, the retaining portions may be circular, V-shaped, triangular shaped, box shaped, or half box shaped as shown in FIG. 3B-3F, respectively. Similarly, although the retaining member 390 member has been illustrated as having a circular cross section, the retaining member 390 may have a polygon shaped cross section (such as a triangular, square, rectangular, hexagonal, or octagonal) or an elliptically shaped cross section. The above examples of the retaining member 390 and the first and second connection assemblies 300 and 300* are merely exemplary and are not intended to limit the scope of the invention.

Figure 5:
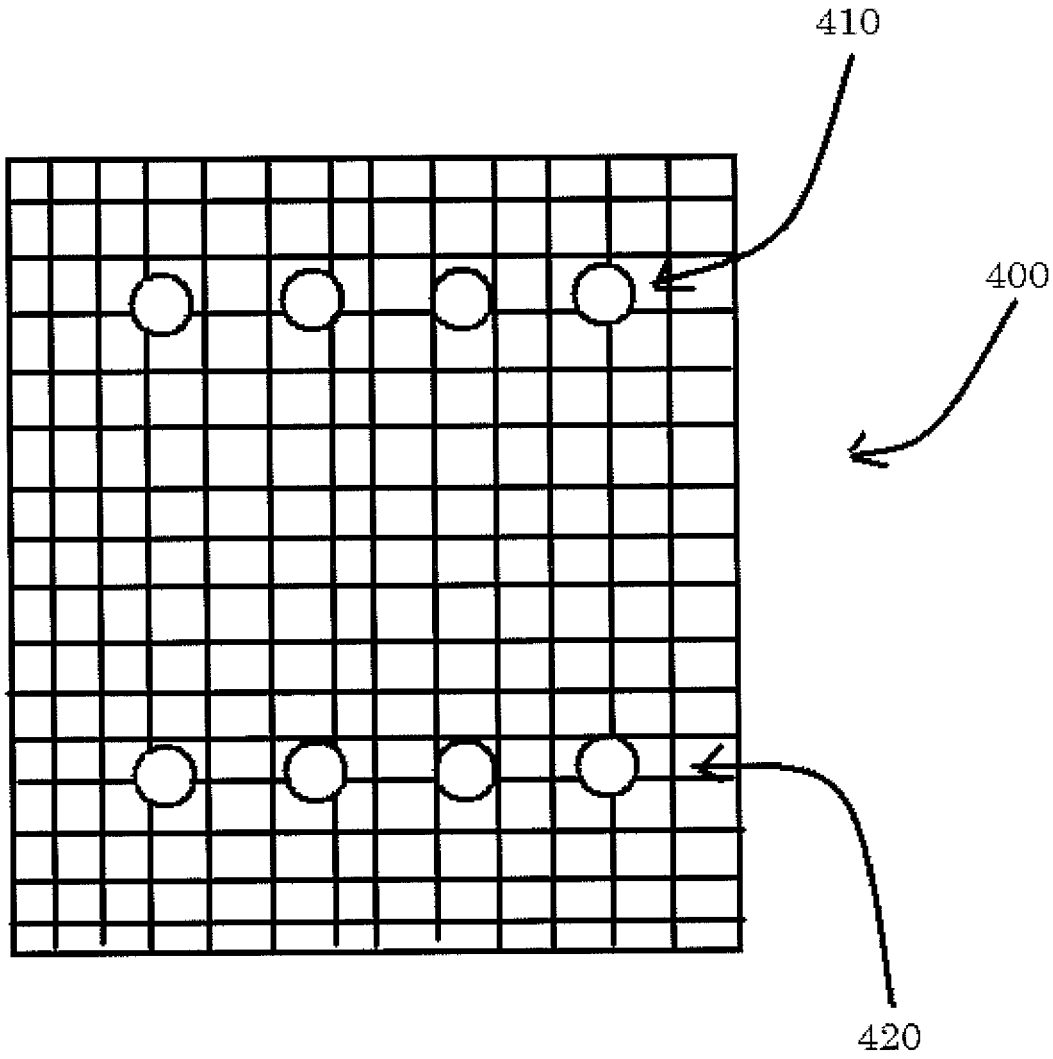
FIG. 5 is a view of a lath in accordance with example embodiments.

FIG. 5 is an example of a lath 400 in accordance with example embodiments. In example embodiments, the lath 400 may be comprised of a wire mesh made from a metal, a plastic, a polymer, and/or rubber, as is well known in the art. In FIG. 5 the lath 400 is illustrated as having a grid like pattern that includes a plurality of rectangular cells. The lath 400 of example embodiments is merely exemplary as laths may be formed to have of a plurality diamond shaped cells, triangular shaped cells, octagonal shaped cells, or hexagonal shaped cells.

In example embodiments, the lath 400 may be formed with at least one plurality of apertures. For example, in FIG. 5, the lath 400 is illustrated as having a first plurality of apertures and a second plurality of apertures 420. In example embodiments, the first plurality of apertures 410 may have substantially the same pattern as a first plurality of apertures present in either the first or second panels 100 and 200. For example, the first plurality of apertures 410 may have substantially the same pattern as the first plurality of apertures 110 of the first panel 100 (or a plurality of holes in the second panel 200 since the second panel 200 may be substantially identical to the first panel 100). Similarly, the second plurality of apertures 420 may have substantially the same pattern as the second plurality of apertures 120 of the first panel 100 (or a plurality of holes in the second panel 200 since the second panel may be substantially identical to the first panel 100). Thus, if the lath 400 were superimposed over the first panel 100, the first and second pluralities of apertures 410 and 420 of the lath 400 may overlie the first and second pluralities of holes 110 and 120 of the first panel 100.

Figure 6:
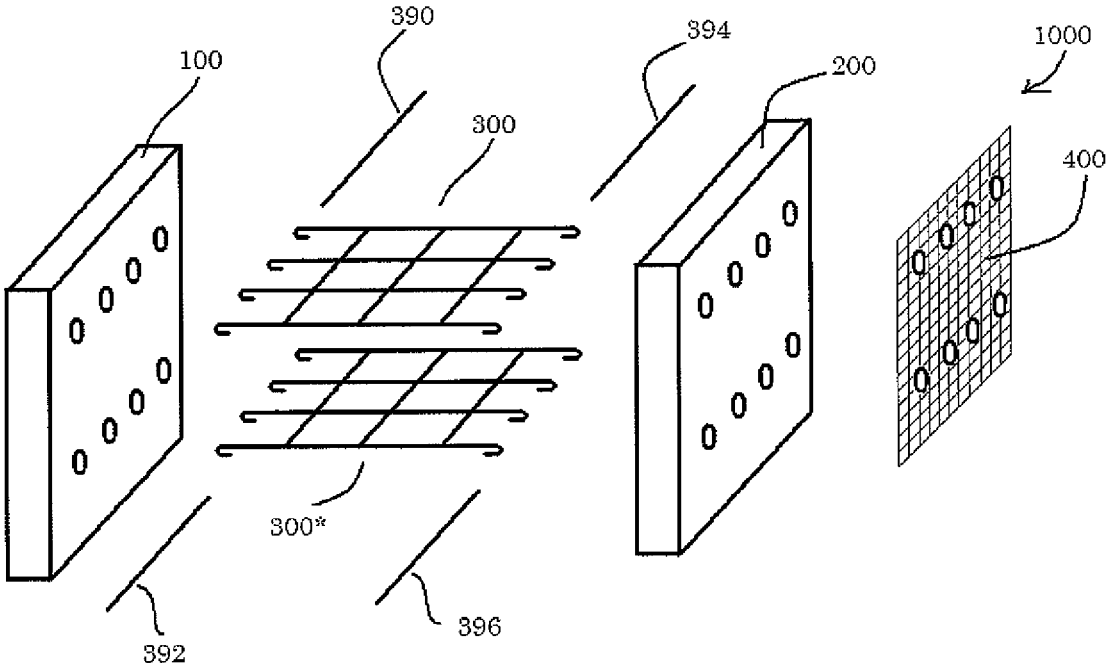
FIG. 6 is an exploded view of the form system in accordance with example embodiments.
Figure 7A:
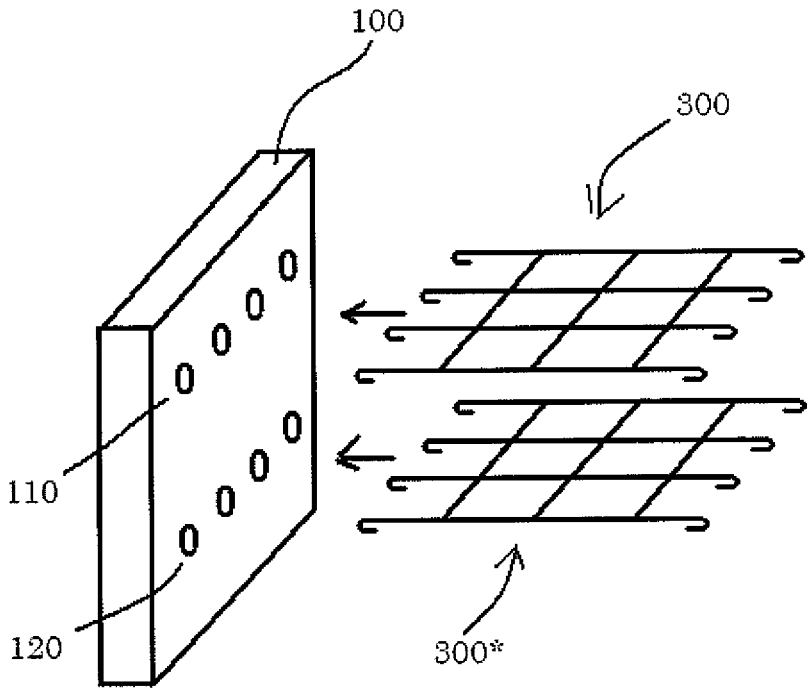
FIGS. 7A-7O are view for assembling a form system in accordance with example embodiments.
Figure 7B:
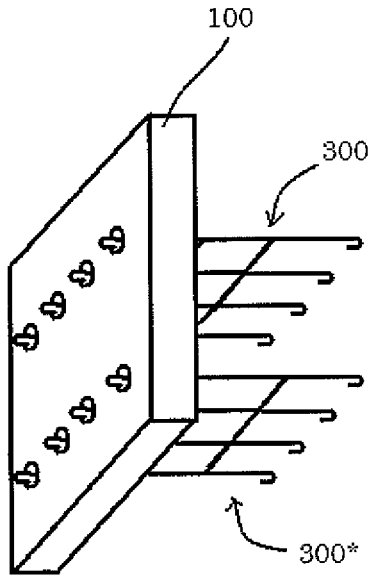
Figure 7C:
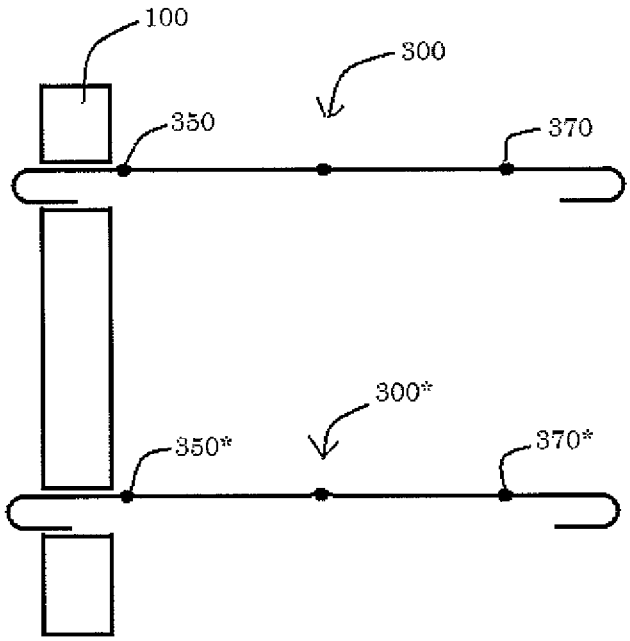
Figure 7D:
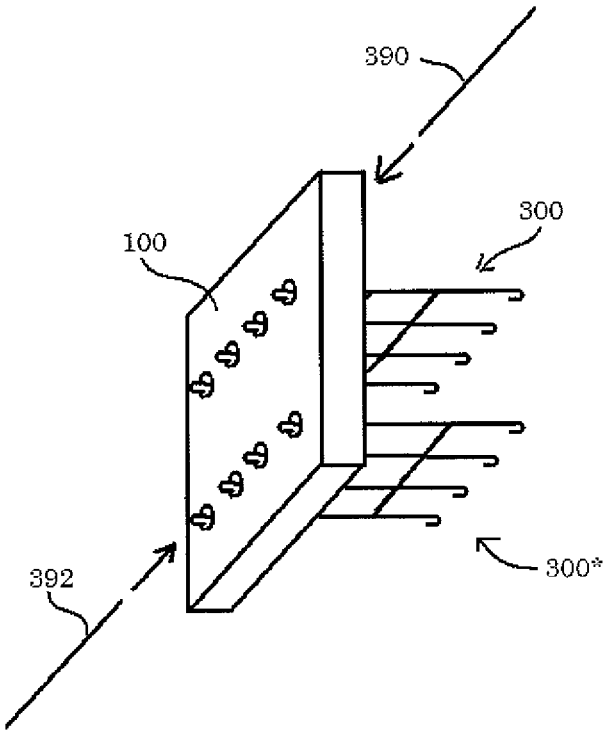
Figure 7E:
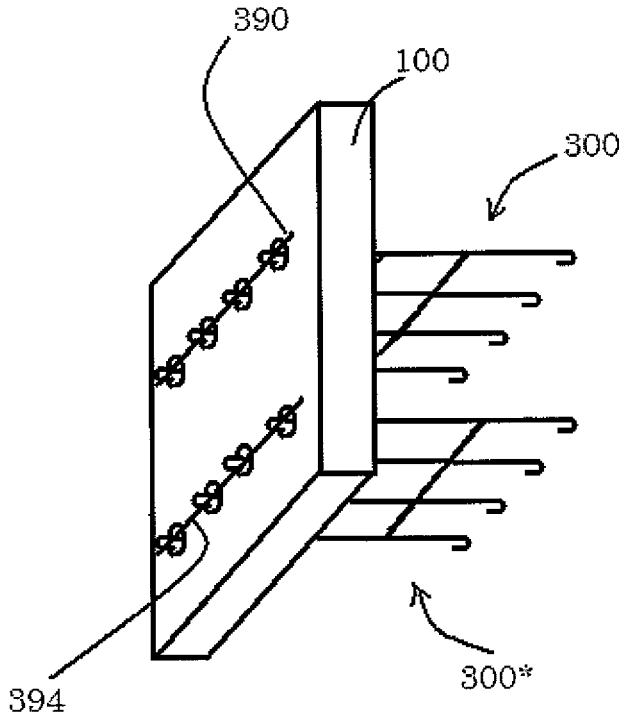
Figure 7F:
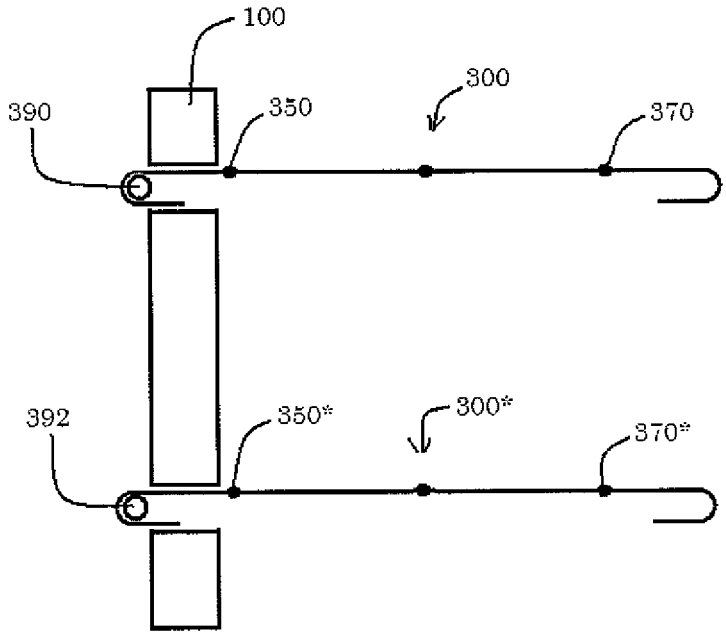

FIG. 6 is an exploded view of a form system 1000 in accordance with example embodiments. FIGS. 7A-7O are figures illustrating an example method of assembling the form system 1000 in accordance with example embodiments. Referring to FIG. 6, it is noted that the form system 1000 of example embodiments comprises a first panel 100, a second panel 200, a first connection assembly 300, a second connection assembly 300*, a first retaining member 390, a second retaining member 392, a third retaining member 394, a fourth retaining member 396, and a lath 400. In example embodiments, the first panel 100 may include two pluralities of apertures wherein each plurality of apertures includes four apertures. In this particular nonlimiting example, the first connection assembly 300 may include four cross bars having a spacing that allows them to be inserted into one of the pluralities of apertures of the first panel 100 and the second connection assembly 300* may include four cross bars having a spacing that allows them to be inserted into the other of the pluralities of apertures of the first panel 100. The second panel 200 may include two pluralities of apertures wherein each plurality of apertures includes four apertures. In this particular nonlimiting example, the pluralities of holes of the second panel 200 may be arranged such that the cross bars of the first and second connections assemblies 300 and 300* may be inserted therein. In this example, the lath 400 may also include two pluralities of apertures wherein each plurality of apertures includes four apertures. In this particular nonlimiting example, the pluralities of holes of the lath 400 may be arranged such that the cross bars of the first and second connections assemblies 300 and 300* may be inserted therein.

FIG. 7A illustrates an operation wherein ends of the first and second connection assemblies 300 and 300* are inserted into the first and second pluralties of holes 110 and 120 of the first panel 100. As shown in FIGS. 7B and 7C, retaining portions of the first and second connection assemblies 300 and 300* extend through the thickness of the first panel 100 and are exposed on an outer side of the first panel 100. In this configuration, an outer rod 350 of the first connection assembly 300 and an outer rod 350* of the second connection assembly 300* is close to or in contact with an inner side of the first panel 100. In FIG. 7D, the first and second retaining members 390 and 392 are shown being inserted into the retaining portions of the first and second connection assemblies 300 and 300* thereby preventing the first and second connection assemblies 300 and 300* from being pulled back through the first and second pluralities of holes 110 and 120 of the first panel 100. FIGS. 7E and 7F illustrate the first and second retaining members 390 and 392 being inserted into retaining portions of the first and second connection assemblies 300.

Figure 7G:
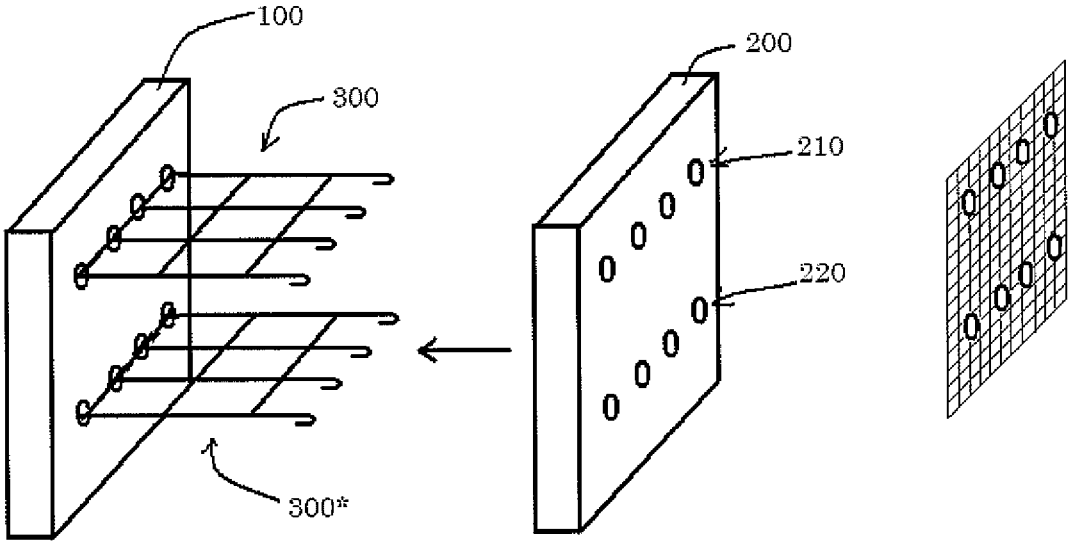
Figure 7H:
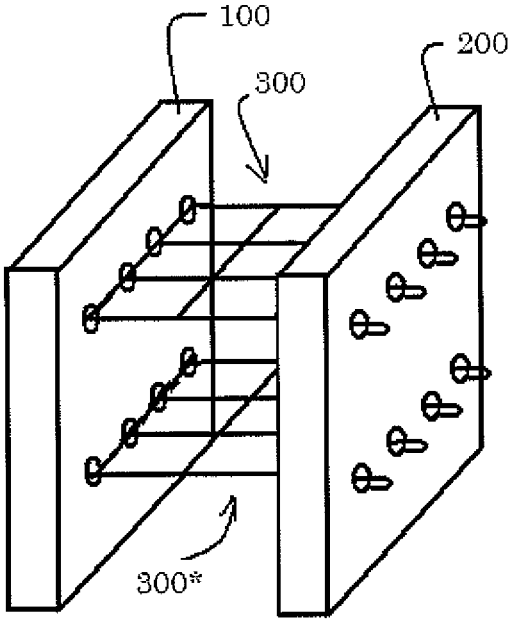
Figure 7I:
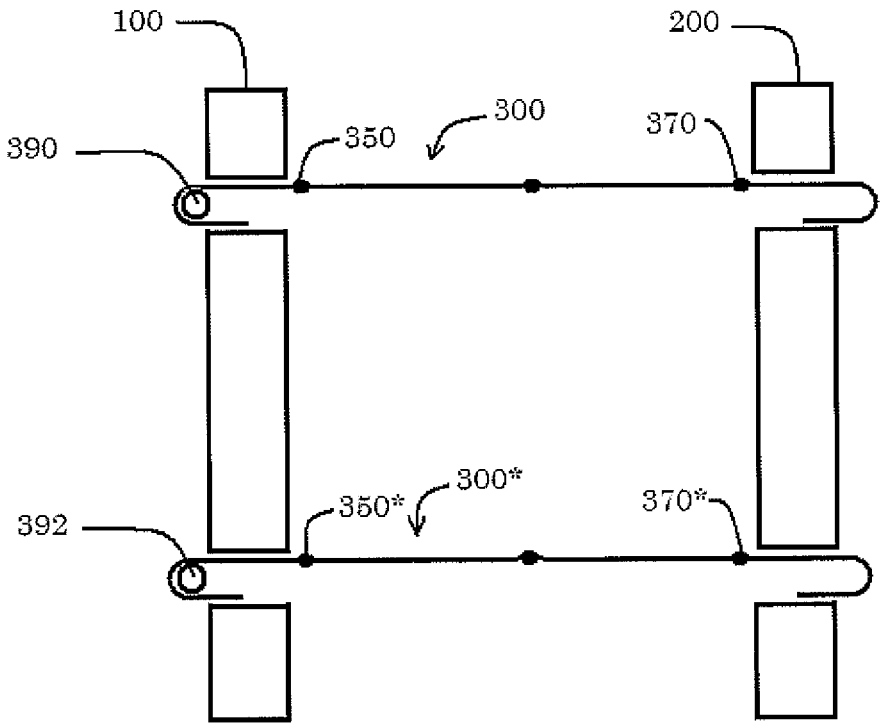

FIG. 7G illustrates an operation wherein ends of the first and second connection assemblies 300 and 300* are inserted into the first and second pluralties of holes 210 and 220 of the second panel 200. As shown in FIGS. 7H and 7I, retaining portions of the first and second connection assemblies 300 and 300* extend through the thickness of the second panel 200 and are exposed on an outer side of the second panel 200.

Figure 7J:
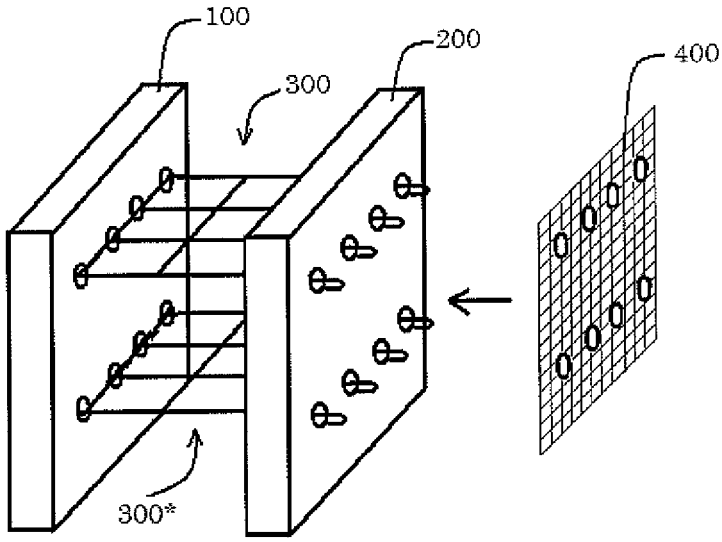
Figure 7K:
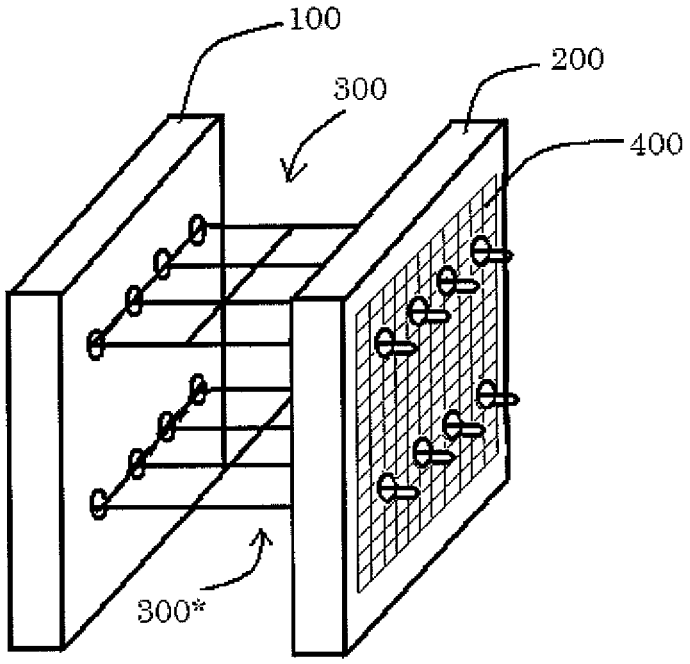
Figure 7L:
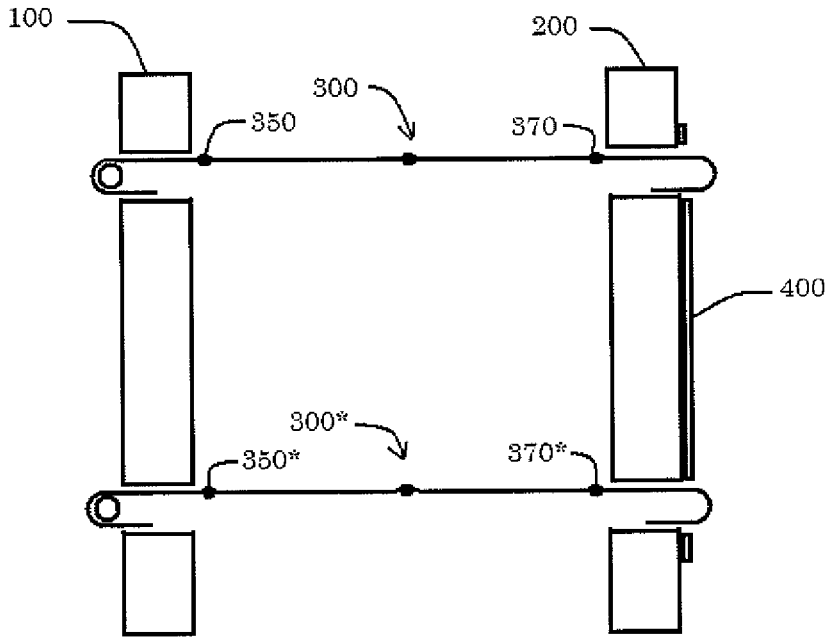
Figure 7M:
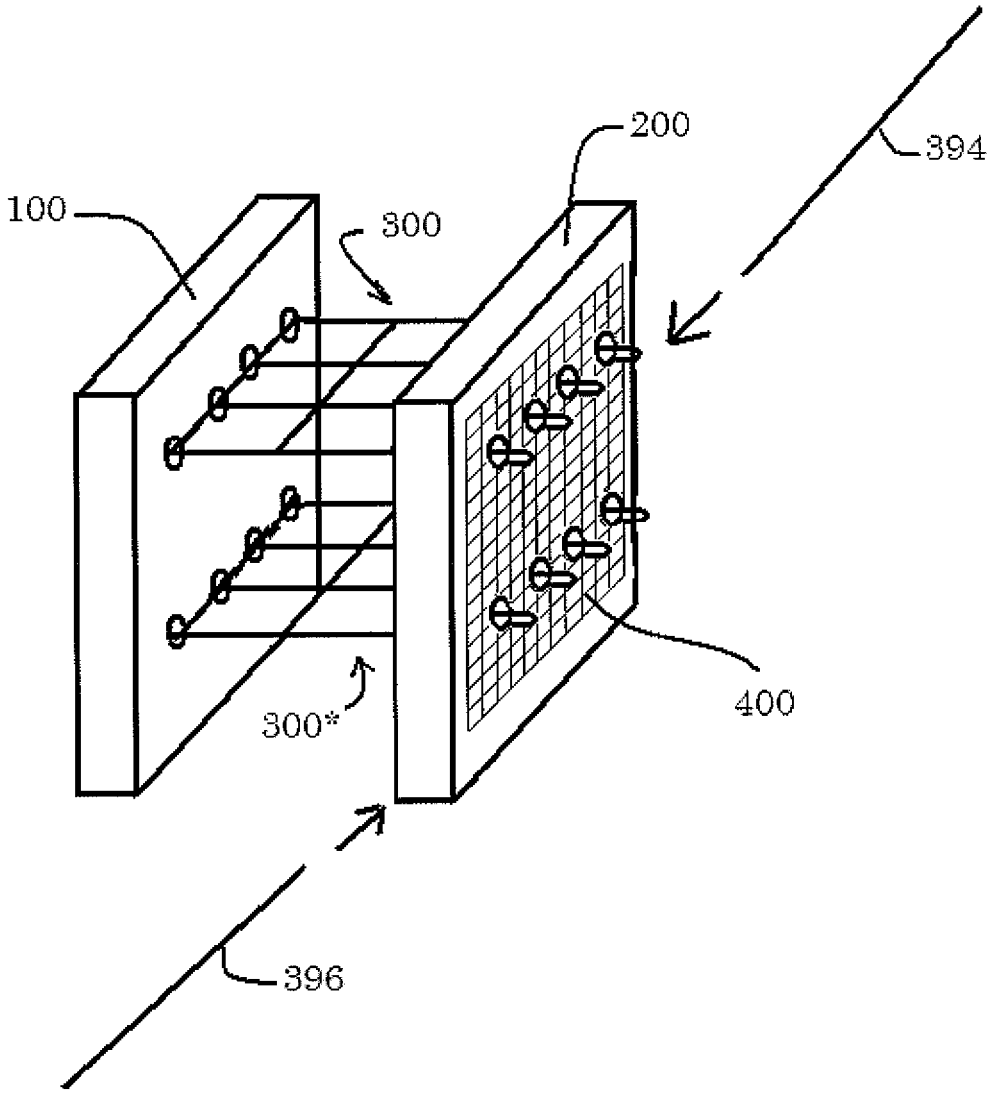
Figure 7N:
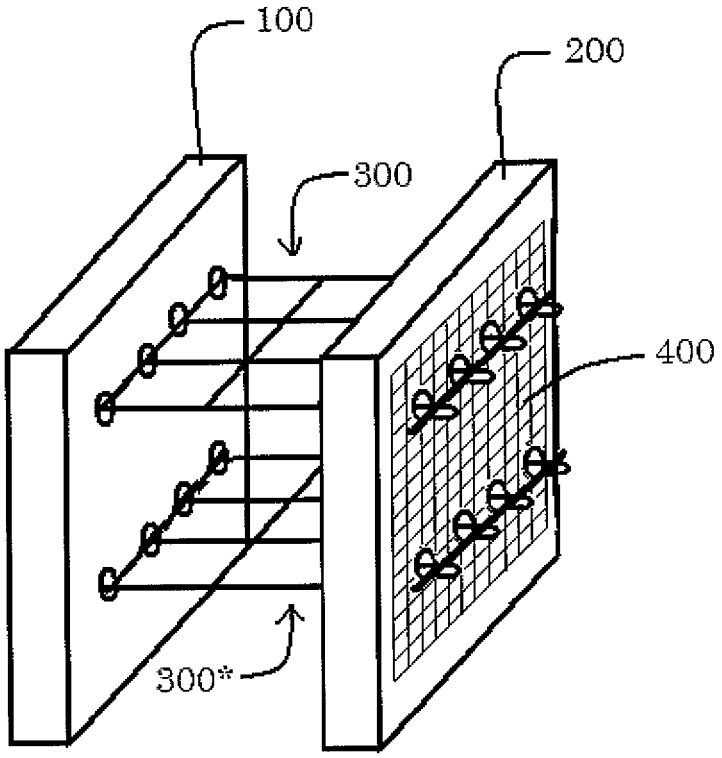
Figure 7O:
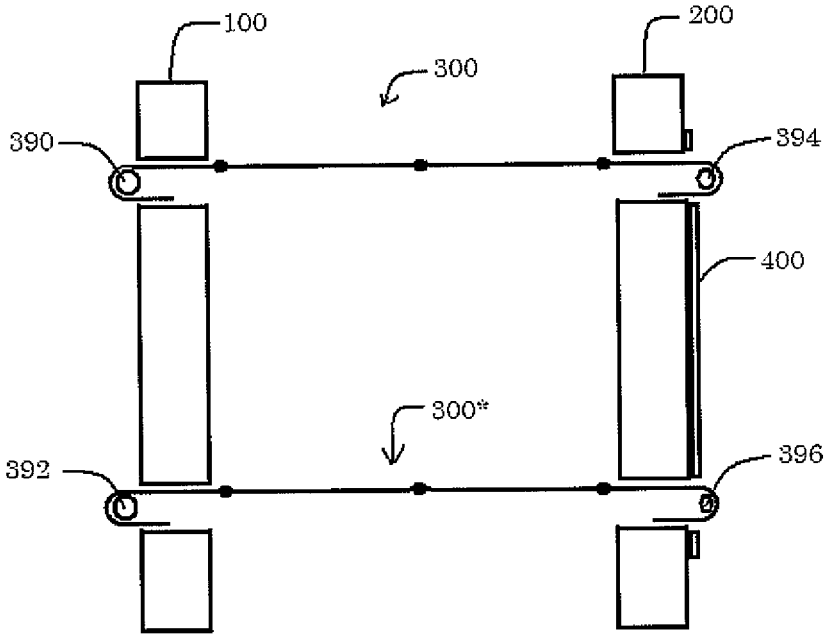
Figure 8:
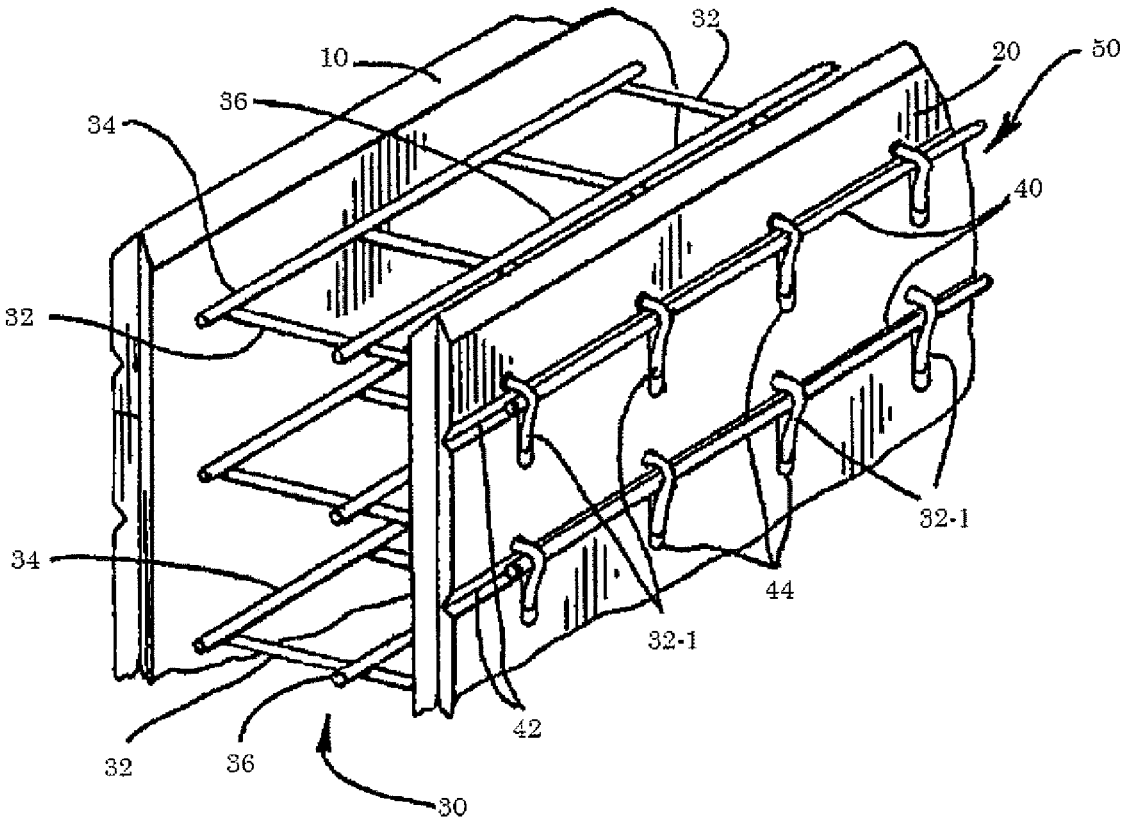
FIG. 8 (Prior Art)
FIG. 8 is a view of a prior art concrete form system.

FIG. 7J illustrates an operation wherein the lath 400 is placed on the outer side of the second panel 200. In this operation, the lath 400 is placed on the outer side of the second panel so that retaining portions of the first and second connection assemblies 300 and 300* extend through the pluralities of holes of the lath 400 as shown in FIGS. 7K and 7L. In this configuration, an outer rod 370 of the first connection assembly 300 and an outer rod 370* of the second connection assembly 300* may be close to or in contact with an inner side of the second panel 200. In FIG. 7M, the third and fourth retaining members 394 and 396 are shown being inserted into the retaining portions of the first and second connection assemblies 300 and 300* thereby preventing the first and second connection assemblies from being pulled back through the first and second pluralities of apertures 210 and 220 of the second panel 200. FIGS. 7N and 7O illustrate the third and fourth retaining members 394 and 396 inserted into retaining portions of the first and second connection assemblies 300. In this particular nonlimiting example embodiment, the third and fourth retaining members 394 and 396 not only prevent the first and second connection assemblies 300 and 300* from being pulled back through the first and second pluralities of holes 210 and 220 of the second panel 200, but also keep, in place, the lath 400.

Example embodiments provide a novel form system 1000 which is usable for fabricating a wall, such as a concrete wall. For example, concrete may be poured between the first panel 100 and the second panel 200 of the form system to form the concrete wall. In the conventional art, walls are often covered with a lath to apply stucco or plaster thereto. In the conventional art screws and anchors are required to attach the lath to the wall. The novel form system 1000, however, has a lath 400 secured to a surface of form system 1000 by a connection assembly which is also usable for connecting one panel of the form system 1000 to another panel of the form system 1000. Thus, the form system 1000 of example embodiments does not require the use of conventional screws or anchors thus reducing cost and time in the fabrication of a lath covered wall.

While example embodiments have been particularly shown and described with reference to example embodiments thereof, it will be understood by those of ordinary skill in the art that various changes in form and details may be made therein without departing from the spirit and scope of the invention.

What is claimed:

1. A concrete form system comprising:

a first panel including a first plurality of apertures;

a first connection assembly including a first bearing structure on a first side of the first panel and a first plurality of cross members penetrating the first plurality of apertures, the first plurality of cross members including a first plurality of retaining portions exposed on a second side of the first panel;

a first retaining member extending through the first plurality of retaining portions; and a lath between the first retaining member and the first bearing structure.

2. The concrete form system according to claim 1, wherein the lath is between the first bearing structure and the first panel.

3. The concrete form system according to claim 1, wherein the lath is between the first panel and the first retaining member.

4. The concrete form system according to claim 1, wherein the lath includes a second plurality of apertures which have substantially a same spacing as the first plurality of apertures.

5. The concrete form system according to claim 1, wherein the first plurality of cross members have substantially a same spacing as a spacing of the first plurality of apertures.

6. The concrete form system according to claim 1, wherein the first bearing structure is a rod.

7. The concrete form system according to claim 1, wherein the first plurality of retaining portions are substantially U-shaped and have an inner diameter smaller than an outer diameter of the first retaining member.

8. The concrete form system according to claim 1, further comprising:

a second panel having a second plurality of apertures; and a second retaining member on a second side of the second panel, wherein the connection assembly further includes a second bearing structure on a first side of the second panel, the first plurality of cross members further includes a second plurality of retaining portions exposed on the second side of the second panel, and the second retaining member extends through the second plurality of retaining portions.

9. The concrete form system according to claim 8, wherein the first plurality of cross bars are substantially parallel, the first and second retaining members are substantially rod shaped, and the first and second retaining members are substantially perpendicular to the first plurality of cross bars.

10. The concrete form system according to claim 8, wherein the first plurality of apertures, the second plurality of apertures, and the first plurality of cross members have a same spacing.

11. The concrete form system according to claim 8, wherein the first and second retaining members are substantially parallel and the first plurality of cross members are substantially perpendicular to the first and second retaining members.

12. The concrete form system according to claim 11, wherein the first plurality of cross members are welded to the first and second bearing members.

13. The concrete form system according to claim 12, wherein each of the plurality of cross members and the first and second retaining members are comprised of ten gauge wire.

14. The concrete form system according to claim 8, further comprising:

a second connection assembly between the first and second panels;

a third retaining member on the second side of the first panel; and a fourth retaining member on the second side of the second panel wherein the first panel includes a third plurality of apertures, the second panel includes a fourth plurality of apertures, and the second connection assembly includes a third bearing structure on the first side of the first panel, a fourth bearing structure on the first side of the second panel, and a second plurality of cross members penetrating the third and fourth pluralities of apertures, the second plurality of cross members including a third plurality of retaining portions exposed on the second side of the first panel and a fourth plurality of retaining portions exposed on the second side of the second panel, and the third retaining member extends through the third plurality of apertures and the fourth retaining member extends through the fourth plurality of apertures.

15. The concrete form system of claim 1, wherein the lath directly contacts the retaining member and the first panel.

* * * * *